US005215271A

United States Patent [19]

Kiriake

[11] Patent Number: 5,215,271

[45] Date of Patent: Jun. 1, 1993

[54] BOBBIN SWITCHING DEVICE FOR WINDING UNITS

[75] Inventor: Masaharu Kiriake, Uji, Japan

[73] Assignee: Murata Kikai Kabushiki Kaisha, Kyoto, Japan

[21] Appl. No.: 861,254

[22] Filed: Mar. 30, 1992

[30] Foreign Application Priority Data

Apr. 5, 1991 [JP] Japan ..... 3-31172[U]

[51] Int. Cl.[5] ..... B65H 67/02

[52] U.S. Cl. ..... 242/35.5 A

[58] Field of Search ..... 242/35.5 A, 35.5 R, 242/35.6 R, 18 R

[56] References Cited

U.S. PATENT DOCUMENTS 3,399,840 9/1968 Hayashi et al. ..... 242/35.5 R
4,463,909 8/1984 Kiriake et al. ..... 242/35.5 A
4,597,540 7/1986 Kiriake ..... 242/35.5 A
4,953,798 9/1990 Tone et al. ..... 242/35.5 A X

*Primary Examiner*—Stanley N. Gilreath
*Attorney, Agent, or Firm*—Spensley, Horn, Jubas & Lubitz

[57] ABSTRACT

A bobbin switching device for winding units comprising a disk rotatable in taking-in direction along a lower surface of a passage on the taking-in side for taking-in a bobbin erected on a tray from a bobbin supply conveyor to a winding position, and a turnable eject lever for holding a bobbin at a winding position and ejecting an empty bobbin from a winding position to an empty bobbin eject conveyor via a passage on the eject side. The eject lever is driven through a cam row of a winding unit U, wherein the disk is rotatable by mounting of a ratchet wheel and a pawl and the pawl is operatively connected to the eject lever through the cam row and driven.

7 Claims, 6 Drawing Sheets

BOBBIN SWITCHING DEVICE FOR WINDING UNITS

BACKGROUND OF THE INVENTION

1. Field of the Invention

The present invention relates to a bobbin switching device for winding units of an automatic winder. Spinning bobbins are supplied to winding positions of a number of winding units arranged in parallel with each other and at the same time, empty bobbins are ejected by the bobbin switching device.

2. Prior Art

A conventional bobbin switching device of this kind has been known from the disclosure of Japanese Patent Application Laid-Open No. 69370/1984. This bobbin switching device will be described hereinbelow with reference to FIGS. 4 and 5. In FIG. 4, reference character U denotes a number of winding units disposed at fixed intervals in a lateral direction in front and in the rear as viewed in paper; 1, a bobbin supply conveyor which runs along the units U; 2, an empty bobbin eject conveyor which runs along the units U; and 3, a bobbin switching device arranged between both the conveyors 1 and 2. The bobbin supply conveyor 1 transports a bobbin 4 erected on a tray 5. A peg 7 is stood upright on the tray 5 in the form of a hollow disk through a shoulder 6, the bobbin 4 is placed in an upright attitude on the shoulder 6 through a lower end of a take-up tube 8 of the bobbin inserted into the peg 7, a through hole 10 to communicate a hollow portion in the tray 5 with a center hole 9 of the take-up tube 8 is provided at the end of the peg 7, and the bobbin 4 has its yarn end Y found and is hung into the center hole 9. The bobbin supply conveyor 1 and the empty bobbin eject conveyor 2 are arranged at positions different in level, and the bobbin switching device 3 is provided therebetween so as to provide oblique communication with each other. The bobbin 4 is carried to a winding position 11 in the bobbin supply device 3 by the bobbin supply conveyor 1, wound on a package (not shown) by the winding unit U, ejected in the form of an empty take-up tube 8, and carried by the bobbin eject conveyor 2.

The bobbin switching device 3 will be described in detail. In FIG. 5, first and second guide plates 13 and 14 (which form a passage 12 in which the tray 5 is transferred between both the conveyors 1 and 2) are secured to the winding unit U. A rotatable inclined disk 15 forms the lower surface of a passage **12*a* on the taking-in side, and a bottom plate 16 forms the lower surface of a passage 12*b* on the eject side. The bobbin supply conveyor 1, the inclined disk 15, the bottom plate 16 and the bobbin eject conveyor 2 form substantially the same plane continuous to each other, and a part of the inclined disk 15 is in contact with the bobbin supply conveyor 1 and applied with a turning force in a direction as indicated by an arrow a about a shaft 17. The bobbin supply conveyor 1 is further provided with a third guide plate 18 to guide some of the trays 5 being transported in a direction as indicated by an arrow b by the conveyor 1 into the passage 12*a* on the taking-in side and cause the remaining trays 5** to pass.

A stopper 20 having a free roller 19 at the end thereof is pivoted about a shaft 21, and is urged to be rotated in a direction as indicated by an arrow c by means of a spring 22 and comes into contact with a pin 23 to suppress said rotation. When the stopper 20 is in contact with the pin 23, a convex portion 25 of the stopper defines a bobbin standby position 24 at which the passage 12 is narrower than the outside diameter of the shoulder 6 of the tray 5. Consequently, a tray 5 which has been guided by the bobbin supply conveyor 1 into the passage **12*a* on the taking-in side is temporarily stopped at the standby position 24, and two trays 5 are thereby maintained within the passage 12*a*** on the taking-in side.

An eject lever 26 is pivoted about a shaft 28 on the second guide plate 14. The eject lever 26 has a concave portion 31 capable of embracing and holding the shoulder 6 of the tray 5 at the second bended portion of the passage 12, that is, at the winding position 11, and the other side thereof constitutes an arcuate roller support edge 32 about said shaft 28. The shaft 28 of the eject lever 26 is turned by a locking arm which is reciprocated by a push rod 44 which vertically moves by a cam row 43.

The winding position 11 is set on the inclined disk 15, and a plurality of arcuate through holes 34 about the shaft 17 are provided in a portion of the inclined disk 15 corresponding to a portion where the center of the peg 7 passes. As shown in FIG. 4, a nozzle 35 for jetting compressed air toward the through hole 34 is provided at the position where the center position of the peg 7 passes and is located at a level further below the through hole 34. A valve 38 controlled to be opened and closed by a lever 37 is provided between the nozzle 35 and an air hose 36 for supplying air. Air supplied by the hose 36 passes through the valve 38 by the turning of the lever 37 resulting from the turning of a shaft 39, enters a hollow portion of the tray 5 through the through hole 34 of the inclined disk 15 from the nozzle 35, passes through the through hole 10 of the peg 7, flows into the center hole 9 of the take-up tube 8 and upwardly blows the yarn end Y hung into the center hole 9. The blown yarn end Y passes through the yarn guide 40 secured to the winding unit U, is attracted and held by a suction pipe 41 which stands-by at an upper location and is joined with the yarn end on the package side not shown and the yarn is wound. The shaft 39 of the lever 37 is also turned by a locking arm which is reciprocated by a push rod 45 which is vertically moved by the cam row 43.

The operation of the bobbin switching device 3 will be described hereinbelow. First, in a normal winding state shown in FIG. 5, one tray 5 and two trays 5 are positioned at the winding position 11 and at the standby position 24 in the passage **12*a* on the taking-in side, respectively. At that time, a first tray 5*a* at the winding position 11 is supported by and stopped in the concave portion 31 of the eject lever 26 with respect of the shoulder thereof while a second tray 5*b* at the standby position 24 is caused to contact the convex portion of the stopper 20 with the shoulder 6 thereof and suppressed in its feed by the disk 15**.

When the winding operation of the bobbin 4 on the first tray **5*a* from the aforesaid state is completed, the shaft 28 is turned at a fixed angle by the cam row 43 of the winding unit U. Thereby, the eject lever 26 is turned leftward as shown in FIG. 6 while holding the first tray 5*a* within the concave portion 31 and ejects the first tray 5*a* from the passage 12*b* on the eject side onto the bobbin eject conveyor 2. With the rotation of the eject lever 26, a roller support edge 32 of the eject lever 26 comes into contact with the free roller 19 of the stopper 20 to move leftward the convex portion 25** of the stopper 20. Accordingly, the second tray 5*b* is released from the convex portion 25, is sent by the always rotating inclined disk 15 due to the driving force resulting from the friction from the bobbin supply conveyor 1 and comes into contact with and stops at the roller support edge 32 of the eject lever 26.

When the eject lever 26 is returned to its original position, the stopper 20 returns to its original position shown in FIG. 5, and the second tray 5*b* stopped at the roller support edge 32 is sent into the concave portion 31 of the eject lever 26, that is, to the winding position 11. At the same time, the shaft 39 shown in FIG. 4 rotates to release the valve 38, and compressed air from the nozzle 35 is jetted through the through hole 34 of the inclined disk 15 and the through hole 10 of the peg 7 to blow up the yarn end Y of the bobbin 4 so that the yarn end Y is held by the suction pipe 41 to start winding operation.

In the bobbin switching device 3 explained in connection with the prior art, as shown in FIG. 4, the inclined disk 15 runs on the bobbin supply conveyor 1 and obtains the turning force by the friction so that the disk 15 always rotates. In order that the bobbin is supplied and at the same time the empty bobbin is ejected as shown in FIGS. 5 and 6, it is necessary to positively and quickly transport the bobbin at the standby position 24 to the winding position 11. Yarn finding operation of bobbin fails unless the bobbin enters a predetermined winding position 11. In view of this, the always rotating inclined disk 15 is preferable, and the adjacent bobbin supply conveyor 1 is utilized. However, the belt end of the bobbin supply conveyor 1 is pressed by the inclined disks of a number of spindles, and there is the problem in that the belt of the bobbin supply conveyor 1 tends to wear. There is a further problem in that since the bottom surface of the plastic tray 5 is normally stopped and rubbed by the inclined disk 15, the bottom surface of the tray 5 becomes worn.

The present invention has been accomplished in view of the problems noted above with respect to prior art.

OBJECT AND SUMMARY OF THE INVENTION

An object of the invention is to provide a bobbin switching device in which an inclined disk is driven by the operation of a winding unit and can be positively transported from a standby position to a winding position.

For achieving the aforesaid object, the present invention provides a bobbin switching device for winding units, comprising a disk rotatable in a taking-in direction along a lower surface of a passage on the taking-in side for taking-in a bobbin erected on a tray from a bobbin supply conveyor to a winding position, and a turnable eject lever for holding a bobbin at a winding position and ejecting an empty bobbin from a winding position to an empty bobbin eject conveyor via passage on the ejecting side, said eject lever being driven through a cam row of a winding unit, characterized in that said disk is rotatable by mounting of a ratchet wheel and a pawl, and said pawl is operatively connected to the eject lever through said cam row and driven.

The ratchet wheel of the disk plate is rotated by the pawl driven through the cam row and operatively connected to the eject lever of the disk. So the disk is rotated at timing in which the tray at the standby position is transported to the winding position where the tray is held by the eject lever.

DETAILED DESCRIPTION OF PREFERRED EMBODIMENT

Figure 1:
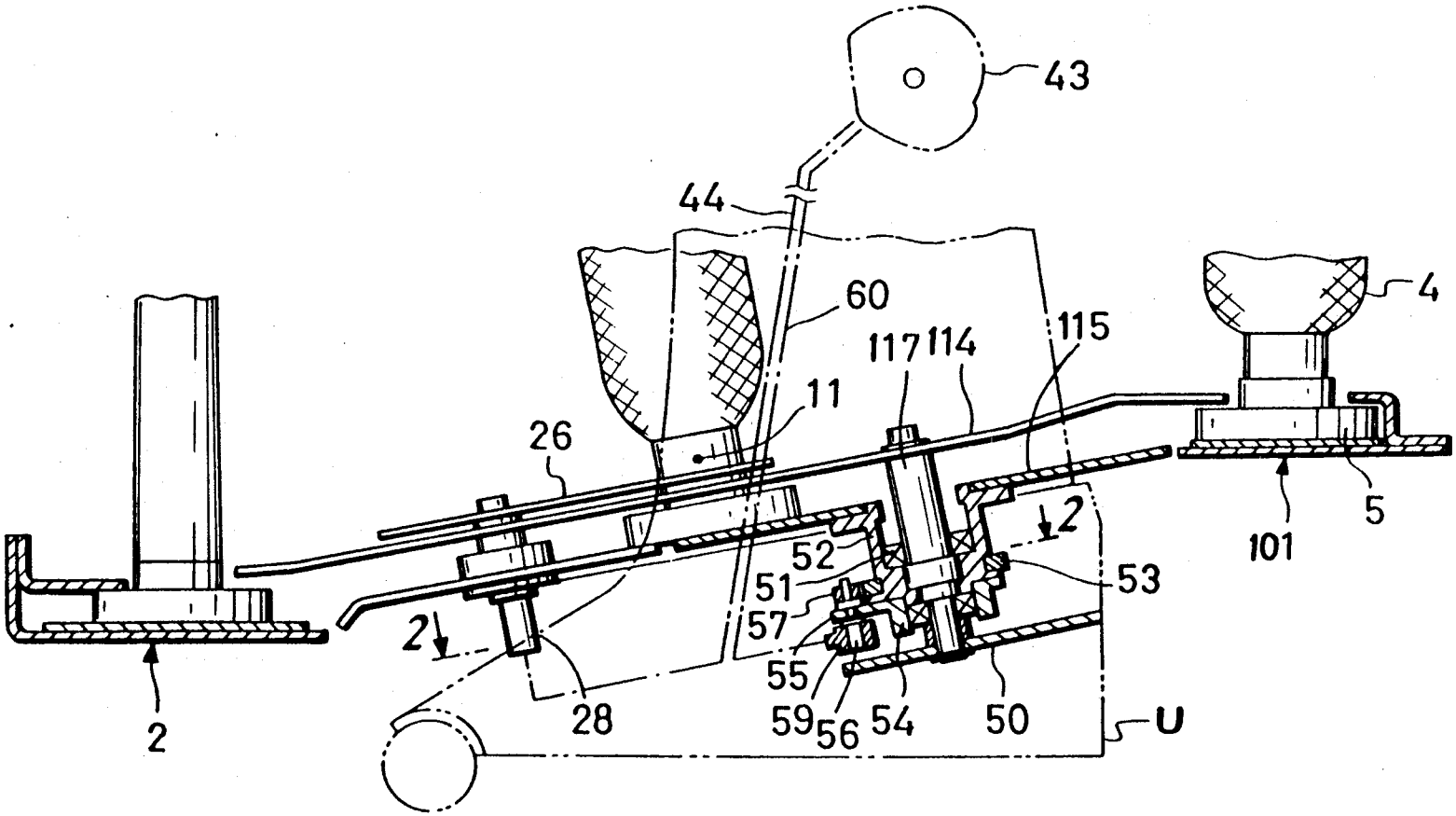
FIG. 1 is a sectional view of essential parts of a bobbin switching device according to the present invention.
Figure 2:
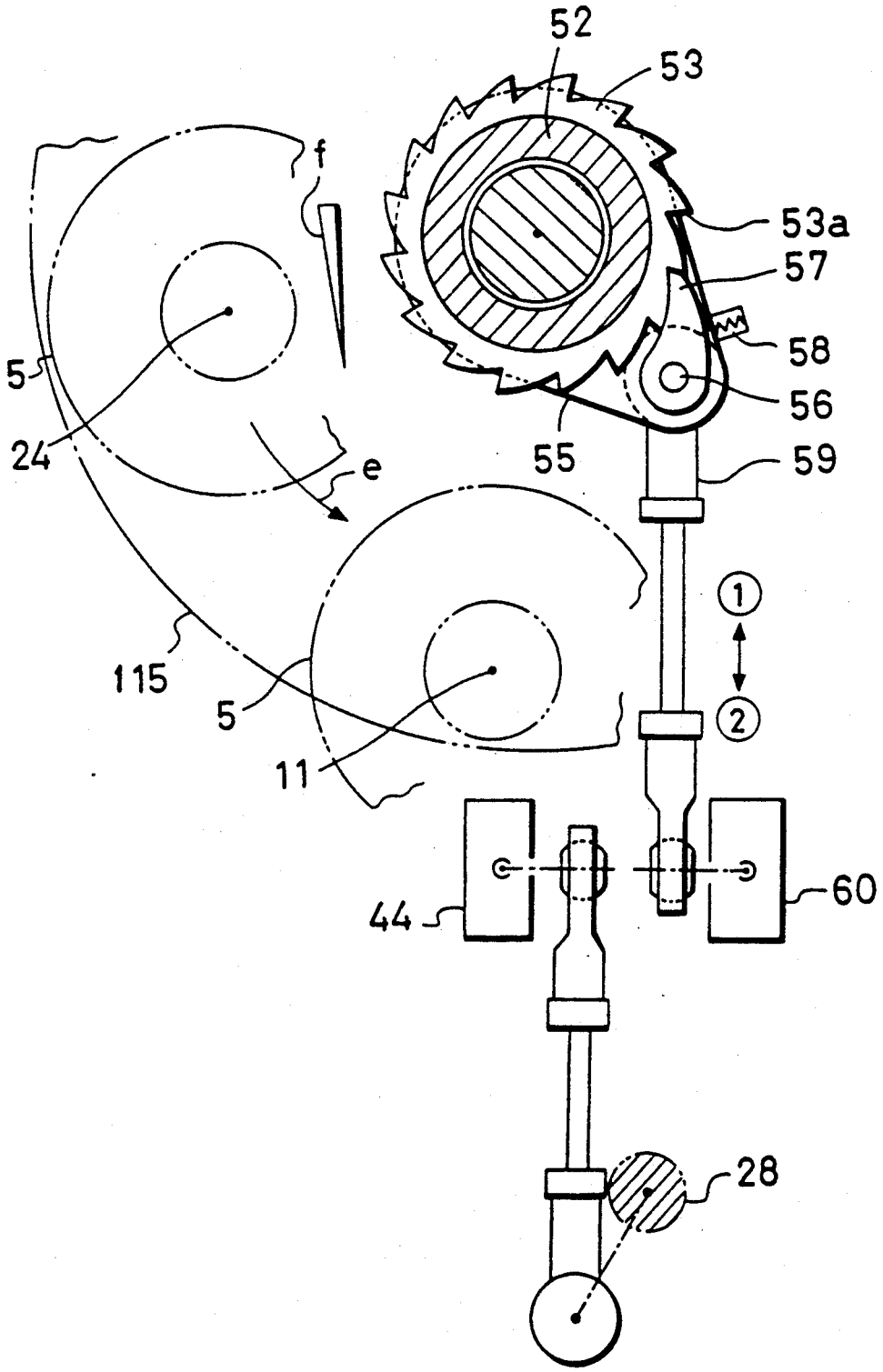
FIG. 2 is a sectional view taken on line A—A of FIG. 1.
Figure 4:
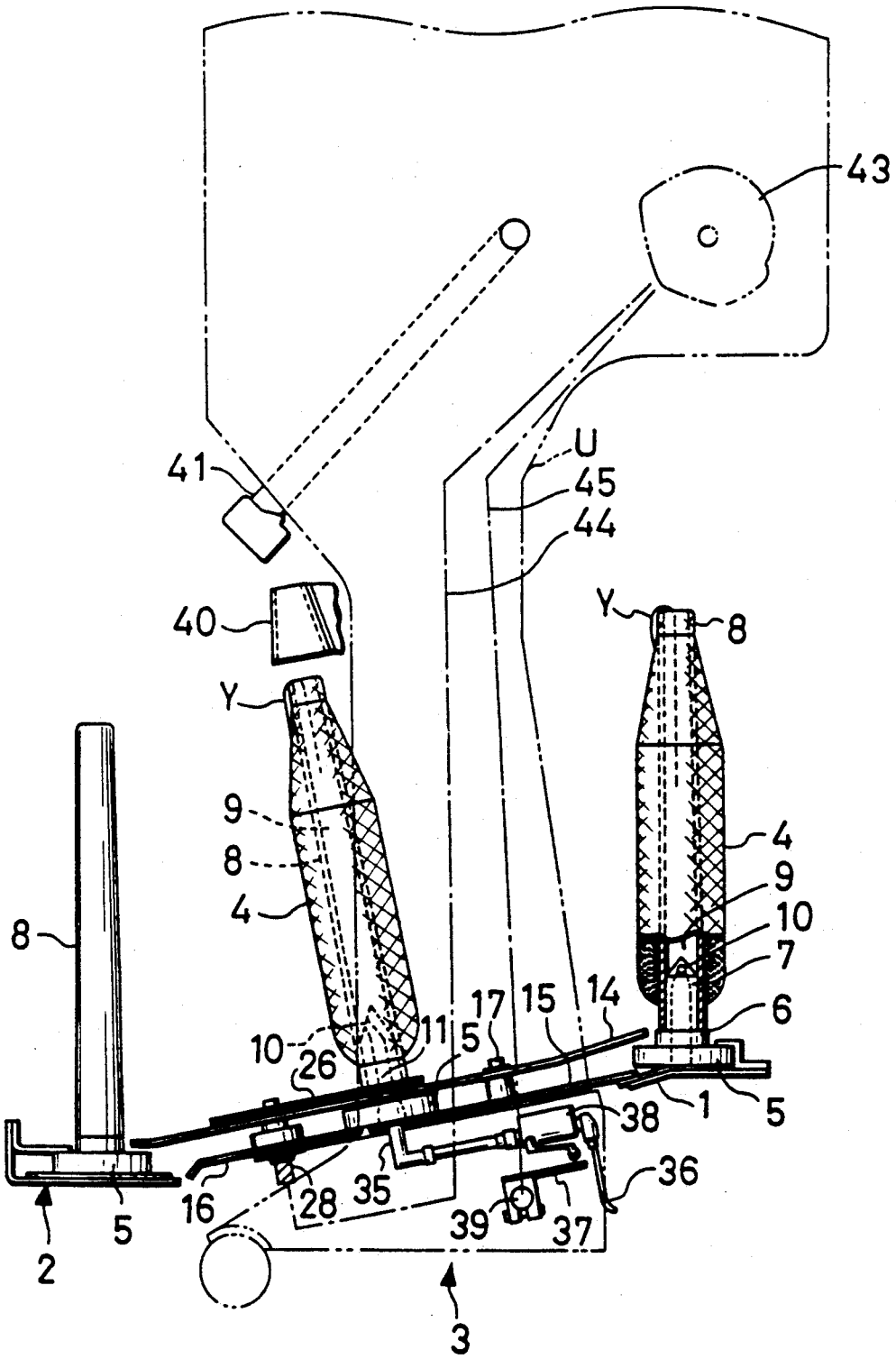
FIG. 4 PRIOR ART
FIG. 4 is a side view of a conventional bobbin switching device.

Embodiments of the present invention will be described hereinafter with reference to the drawings. FIG. 1 is a sectional view showing essential parts of a bobbin switching device according to the present invention, and FIG. 2 is a sectional view taken on line 2—2 of FIG. 1. FIG. 1 is a different from FIG. 4 in a drive mechanism of the inclined disk 115. The inclined disk 115 is so located as the outer peripheral edge of the inclined disk 115 does not contact with the bobbin supply conveyor. The shaft 117 is secured to a bracket 50 extended from the second guide plate 114 and the winding unit U. A bearing box 52 is rotatably mounted on the shaft 117 through a bearing 51, the inclined disk 115 and a ratchet wheel 53 are secured to the bearing box 52. A turning plate 55 is mounted through a bearing 54 separately from the bearing box 52, and a pawl 57 is supported on a shaft 56 stood upright on the turning plate 55. As shown in FIG. 2, the ratchet wheel 53 has a number of blades 53*a*, and the pawl 57 is urged against the blades 53*a* by means of a spring 58. When the turning plate 55 is pressed in a direction of ① by a link member 59 in engagement with the shaft 56, the ratchet wheel 53, that is, the inclined disk 15 rotates in a direction of e, and the tray 5 at the standby position 24 is transported toward the winding position 11. When the link member 59 moves in the direction of the arrow 2, the pawl 57 slips over the blade 53*a*. As a result of the link member 59 moving in the direction of the arrow 2, the inclined disk 115 rotates in a direction opposite to the direction of the arrow e. Because the inclined disk 115 rotates in a direction opposite to the arrow e, it might be assumed that an inadequate feeding force is provided to the tray 5. However, the tray 5 on the inclined disk 115 inclined in a direction f does not idly rotate, since the inclined disk 115 receives a turning moment in the direction of the arrow e due to the weight thereof. It is to be noted that when a reversal preventive mechanism is provided on the inclined disk 115, a horizontally arranged disk can be employed.

Figure 3:
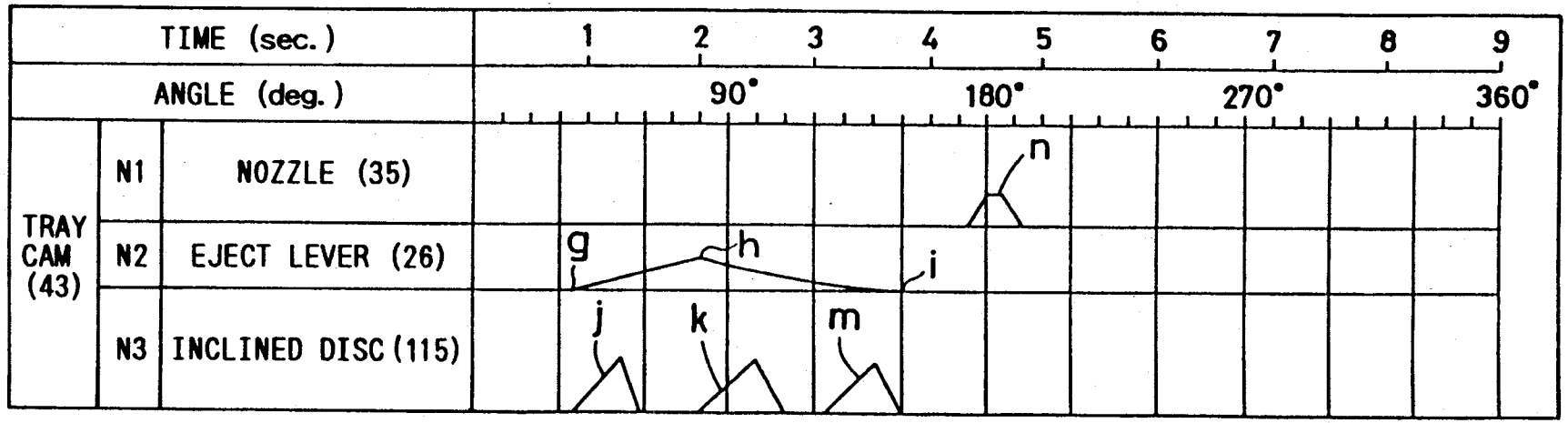
FIG. 3 is a driving timing diagram by a cam row.

Reciprocating movement of the link member 59 for intermittently rotating the inclined disk 115 is effected by a push rod 60. As shown in FIG. 1, the push rod 60 is vertically moved by a common cam row 43 in the winding unit U to push the link member 59 through a locking arm (not shown). The timing of the driving of the inclined disk 115 will be described with reference to FIG. 3. In FIG. 3, N1 is a driving timing of a nozzle 35, N2 is a driving timing of an eject lever 26, and N3 is a driving timing of an inclined disk 115.

Figure 6:
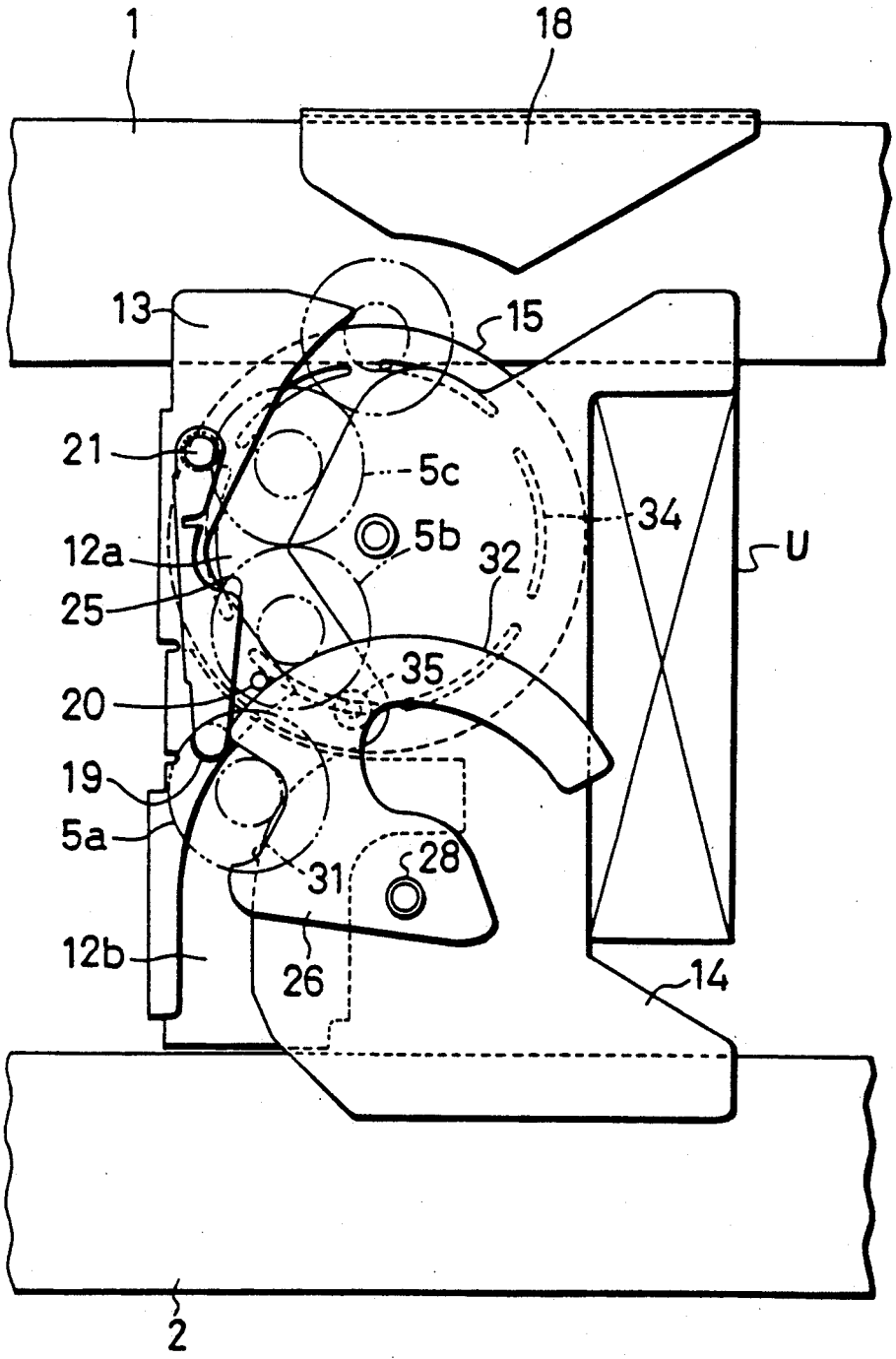
FIG. 6 PRIOR ART
FIG. 6 is an operational status view of the bobbin switching device shown in FIG. 5.

First, the eject lever 26 rotates as shown in FIG. 6. This rotation corresponds to the period g to h shown in FIG. 3. During this period, the inclined disk 115 is rotated by a predetermined angle due to the engagement of the pawl 57 and a first ratchet blade 53*a*. This rotation of the inclined disk 115 is indicated by the letter j in FIG. 3.

Figure 5:
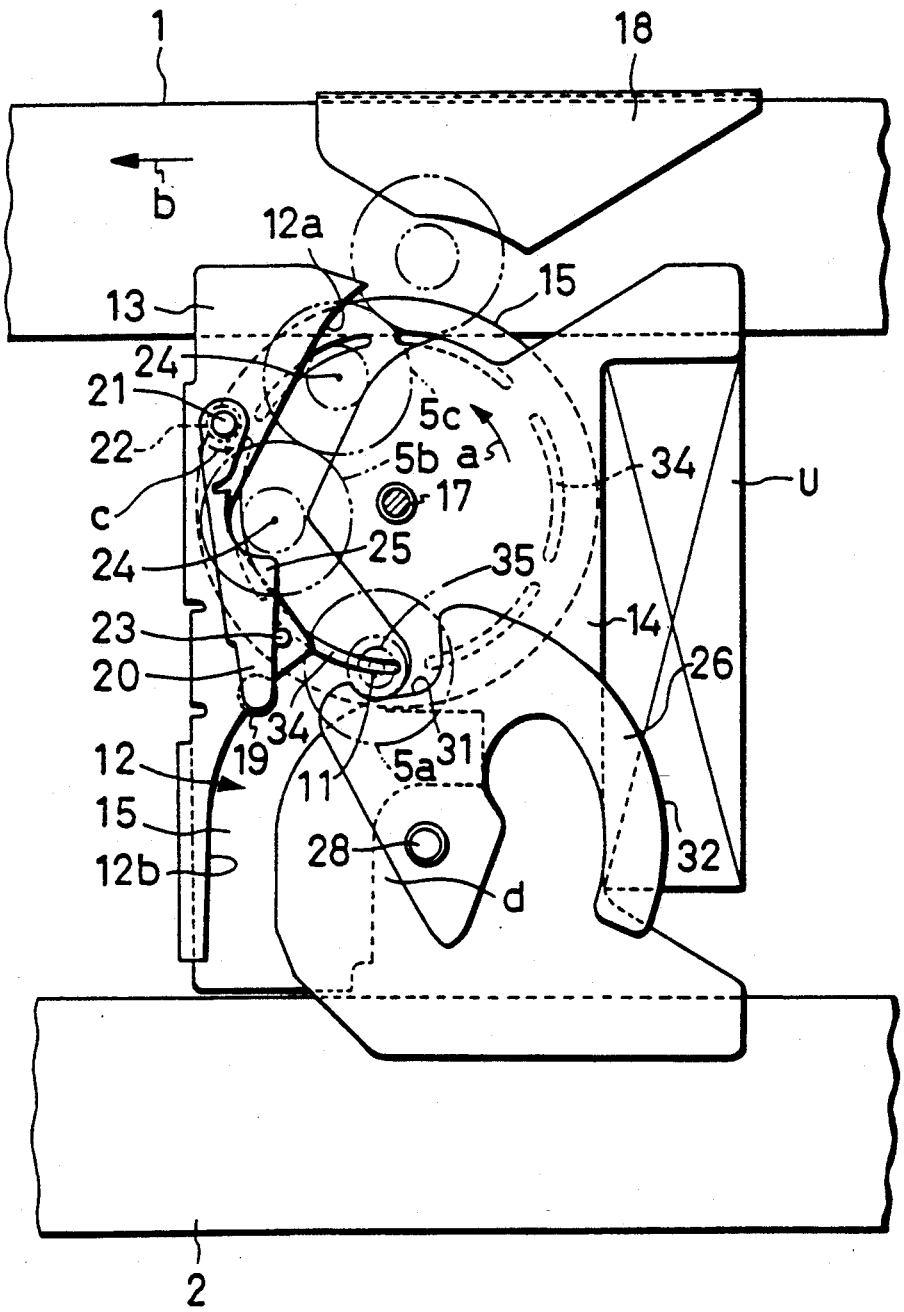
FIG. 5 PRIOR ART
FIG. 5 is a plan view of a conventional bobbin switching device.

Next, the eject lever 26 rotates towards the position shown in FIG. 5. This rotation corresponds to the period h to i shown in FIG. 3. During this period, the inclined disk 115 is rotated by a predetermined angle due to the engagement of the pawl 57 and second and third ratchet blades 53*a*. This rotation of the inclined disk 115 is indicated by the letters k and m in FIG. 3. The tray 5 is transported to the roller support edge 32 of the eject lever 26 as shown in FIG. 6, and the tray 5 is positively transported to the concave portion 31 of the eject lever 26 as shown in FIG. 5. The eject lever 26 returns to its original position at i, and the nozzle 35 is actuated at n to effect yarn-attachment.

A bobbin switching device according to the present invention comprises a disk rotatable in taking-in direction along a lower surface of a passage on the taking-in side for taking-in a bobbin erected on a tray from a bobbin supply conveyor to a winding position, and a turnable eject lever for holding a bobbin at a winding position and ejecting an empty bobbin from a winding position to an empty bobbin eject conveyor via a passage on the ejection side, said eject lever being driven through a cam row of a winding unit, wherein said disk is rotatable by mounting of a ratchet wheel and a pawl, and said pawl is operatively connected to the eject lever through said cam row and driven. The disk is rotated at timing for transporting the tray at the standby position to the winding position where the tray is held by the eject lever, and therefore, the bobbin is positively supplied and wear of trays and the belt of the bobbin supply conveyor can be prevented.

What is claimed is:

1. In a winding unit located between a bobbin supply conveyor and an empty bobbin eject conveyor, the winding unit defining a standby position and a winding position, a bobbin switching device comprising:

guiding means defining a passage through which a tray having a bobbin thereon is guided from the bobbin supply conveyor to the standby position, the passage having a lower surface, rotatable disk means for moving a tray having a bobbin thereon from the standby position to the winding position, the rotatable disk means being in spaced relationship with the bobbin supply conveyor and forming a portion of the lower surface of the passage, and drive means for intermittently rotating the disk at timed intervals to thereby move a tray having a bobbin thereon from the standby position to the winding position.

2. In a winding unit located between a bobbin supply conveyor and an empty bobbin eject conveyor, the winding unit defining a standby position and a winding position, a bobbin switching device comprising:

guide means defining a passage through which a tray having a bobbin thereon is guided from the bobbin supply conveyor to the standby position, the passage having a lower surface, a rotatable disk for moving a tray having a bobbin thereon from the standby position to the winding position, the rotatable disk being in spaced relationship with the bobbin supply conveyor and forming a portion of the lower surface of the passage, an eject lever for maintaining a tray having a bobbin thereon at the winding position and for moving a tray having an empty bobbin thereon from the winding position to the empty bobbin eject conveyor, a cam row for driving the eject lever, and drive means for intermittently rotating the disk and for operatively connecting the disk and eject lever, whereby the disk is intermittently rotated at timed intervals to move a tray having a bobbin thereon from the standby position to the winding position.

3. The device as in claim 2, wherein the drive means comprises:

a ratchet wheel and a pawl for rotating the disk, the pawl being operatively connected to the eject lever through the cam row.

4. The device as in claim 2, wherein the drive means comprises:

a rotatable bearing box mounted to the disk, a ratchet wheel secured to the bearing box and having a plurality of blades, a pawl engageable with the plurality of blades of the ratchet wheel, a shaft for supporting the pawl, a turning plate on which the shaft is supported, and a link member connected with the turning plate.

5. The device as in claim 4, comprising a push rod connected to the cam row for reciprocally moving the link member.

6. The device as in claim 4, wherein the ratchet wheel comprises a plurality of blades, and further comprising a spring for biasing the pawl toward the blades.

7. The device as in claim 2, wherein the disk is positioned to define a plane that is inclined from the bobbin supply conveyor to the empty bobbin eject conveyor.

* * * * *